United States Patent [19]

Vilas Boas et al.

[11] Patent Number: 5,022,217

[45] Date of Patent: Jun. 11, 1991

[54] PACKAGING METHOD, PACKAGING BOLSTER, AND PACKAGING LINE

[75] Inventors: Jean-Claude Vilas Boas, Sannois; Andre Fromion, L'Hay les Roses, both of France

[73] Assignee: Bull, S.A., Paris, France

[21] Appl. No.: 433,005

[22] Filed: Nov. 7, 1989

[30] Foreign Application Priority Data

Nov. 14, 1988 [FR] France ..... 88 14767

[51] Int. Cl.[5] ..... B65B 55/20

[52] U.S. Cl. ..... 53/472; 53/156; 53/238

[58] Field of Search ..... 53/474, 472, 449, 157, 53/156, 155, 154, 238, 239

[56] References Cited

U.S. PATENT DOCUMENTS

| | | | |
|---|---|---|---|
| 3,339,722 | 9/1967 | Van Antwerpen | 206/62 |
| 3,667,593 | 6/1972 | Pendelton | 53/472 X |
| 4,800,708 | 1/1989 | Sperry | 53/472 X |

FOREIGN PATENT DOCUMENTS

| | | | |
|---|---|---|---|
| 17491 | 2/1978 | Japan | 53/472 |

*Primary Examiner*—James F. Coan

*Attorney, Agent, or Firm*—Kerkam, Stowell, Kondracki & Clarke

[57] ABSTRACT

The present invention relates to a packaging method. It also relates to a packaging bolster and to a packaging line employing the method of the invention. The bolster of the invention, adapted particularly to the method of the invention, includes at least one flexible base material or support of elongated shape and indefinite length, intended to be trimmed to the dimension required at the packaging site, the base material carrying spacer elements for spacing apart the product to be packaged at predetermined positions. The bolster is remarkable in that the base material includes at least two films weldable in such a way as to make cushions or bulges filled with a swelling agent.

17 Claims, 12 Drawing Sheets

FIG. 9a
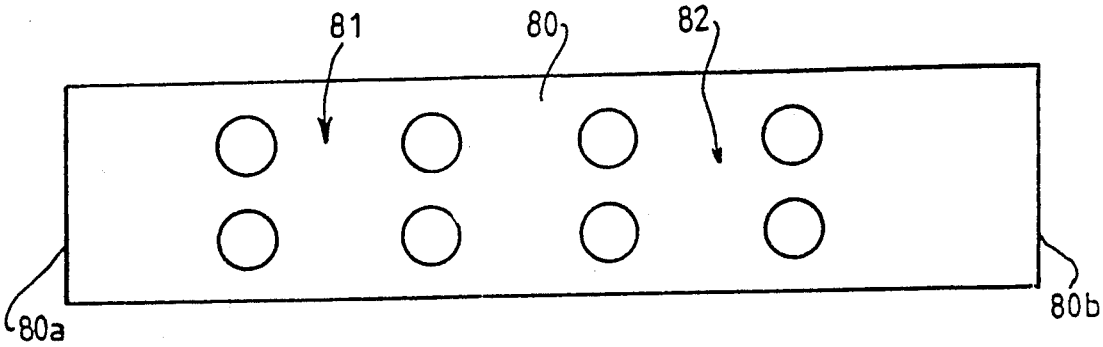
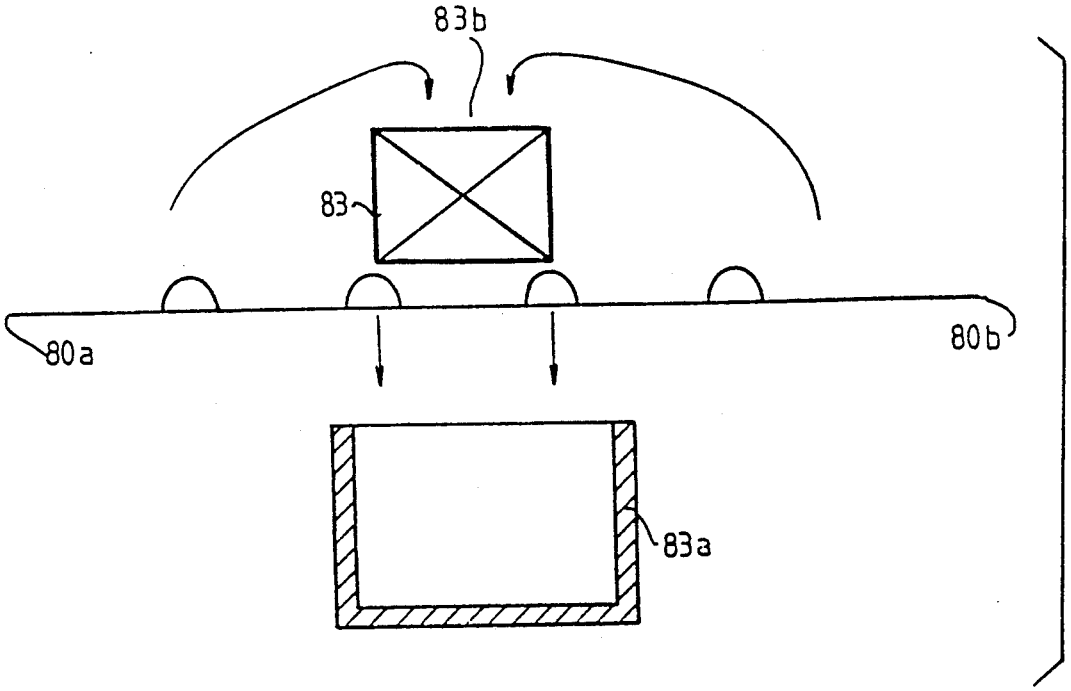
FIG. 9b

FIG. 12
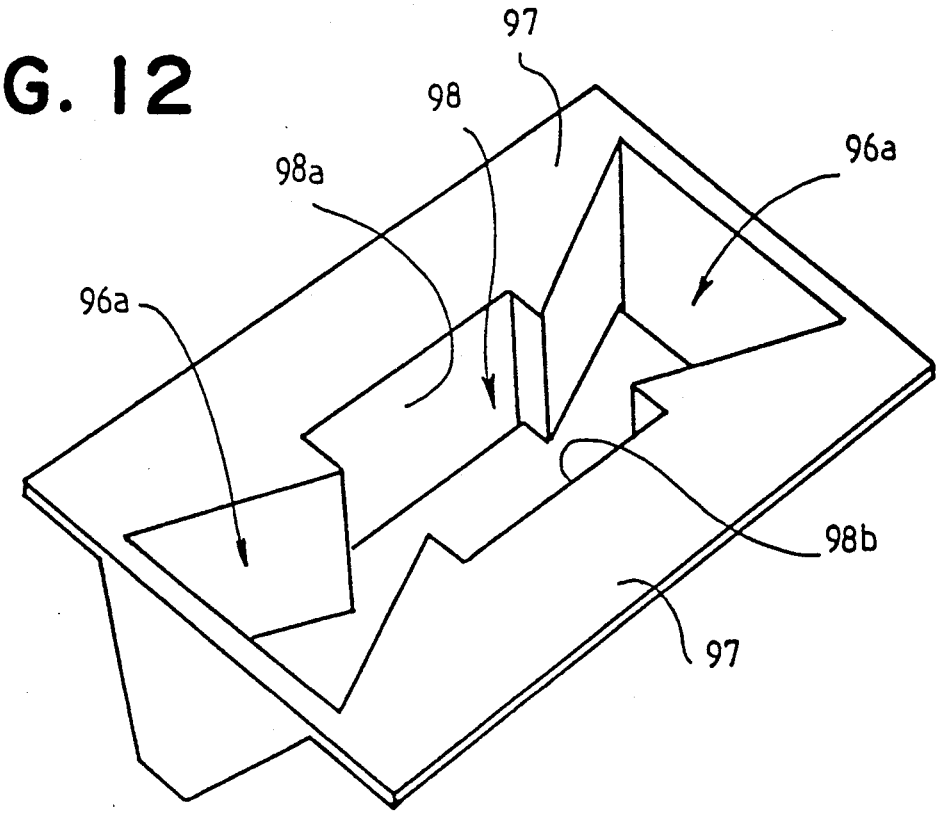
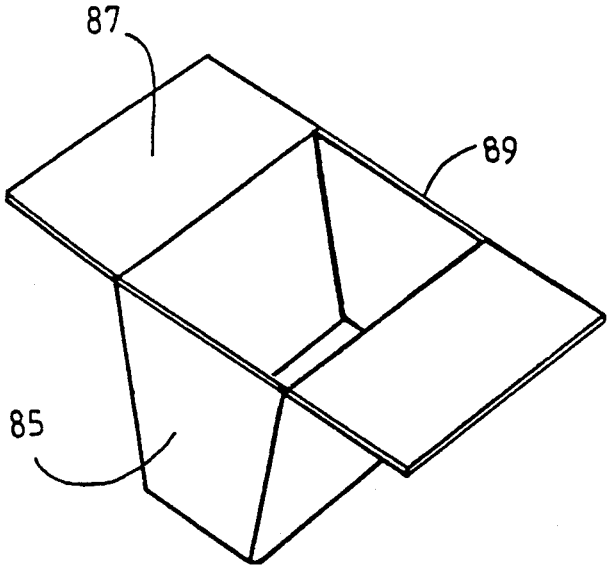
FIG. 11

FIG. 13
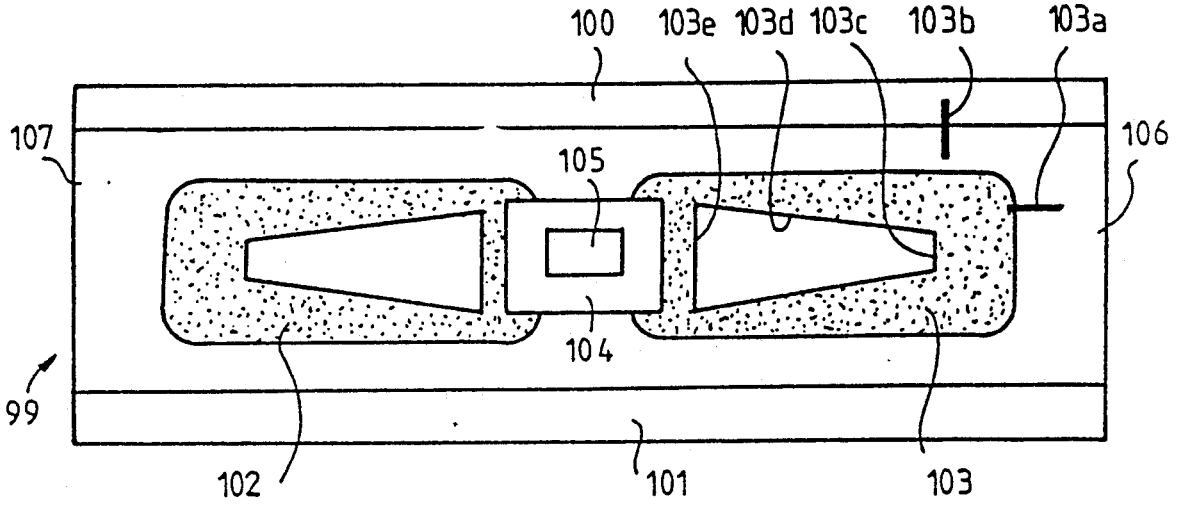
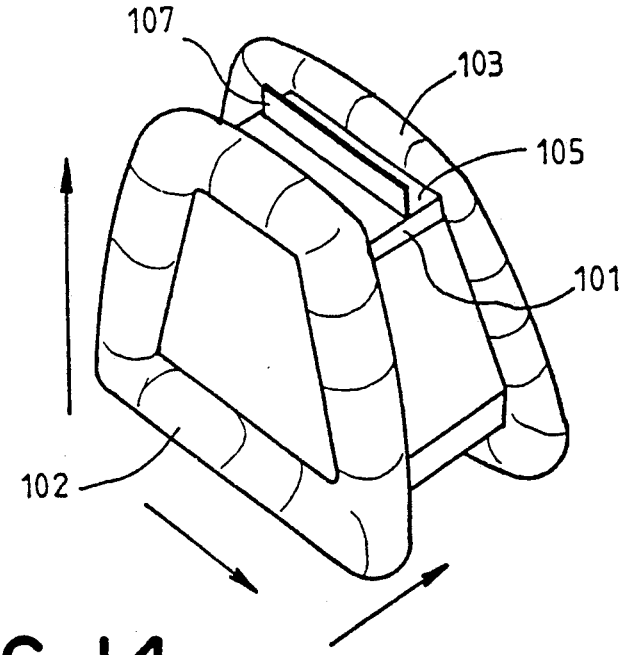
FIG. 14

FIG. 18a
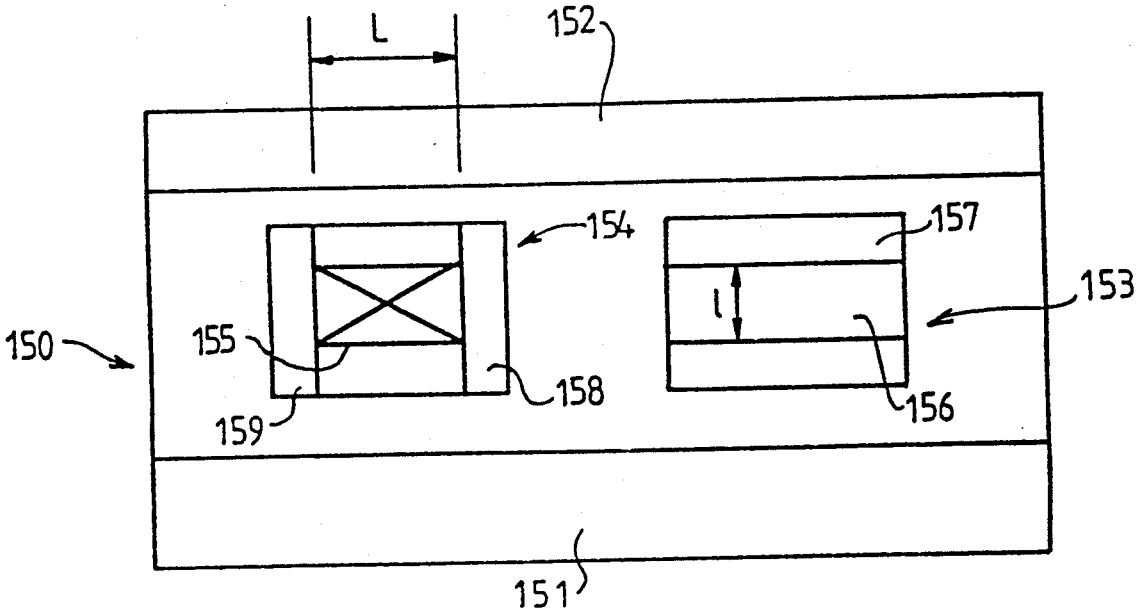
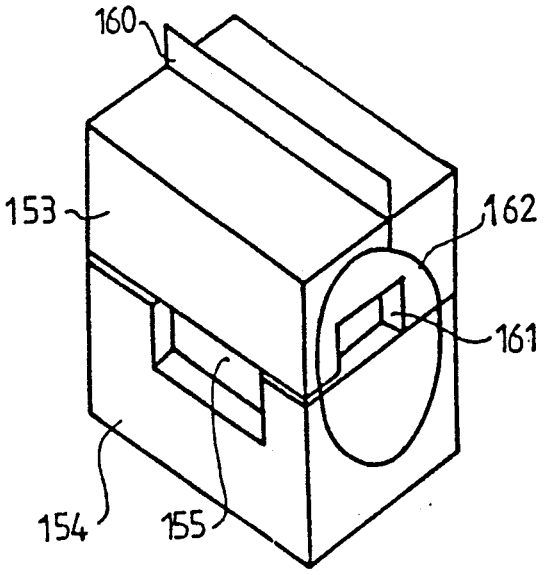
FIG. 18b

PACKAGING METHOD, PACKAGING BOLSTER, AND PACKAGING LINE

FIELD OF THE INVENTION

The present invention relates to a packaging method. It also relates to a packaging bolster and to a packaging line using the method.

BACKGROUND OF THE INVENTION

It is known in the prior art to package fragile objects in cardboard boxes, particularly by disposing one or more bolsters between the interior walls of the packing and the packed or packaged product. The bolsters have two main functions. First, they keep the product away from the walls, to keep forces that would ruin the outer package from reaching the product, as in a glancing blow in which the shock energy in the direction of the impact on the product is not overly high. Second, such bolsters serve as shock absorbers in certain cases. It is understood that in general the economic importance of a package goes far beyond its merely industrial aspect. However, very elaborate apparatus has been invented for specific products exposed to particular environments. Hence the packaging of the product sold makes for a very high added value.

However, in a broader senses, fragile products are not at present protected by particularly heavy-duty packing.

OBJECT AND SUMMARY OF THE INVENTION

A first object of the invention is to propose a novel and particularly sophisticated technique, without entailing extra cost that would make it prohibitive for products of even moderate unit cost.

For relatively fragile products, such as electronics products sold on a large scale, the bolsters of the prior art that are typically encountered include wedge-shaped and half-shell bolsters. Although in numerous cases such devices are satisfactory, they do not allow progress in packaging methods. In fact, by their nature, such bolsters are not adaptable to automated packaging methods.

Another object of the present invention is to propose a packaging method oriented particularly, but not exclusively, to automation of packaging operations.

The present invention relates to a method of packaging a product in a container in which at least one bolster is interposed between the container and the product. The invention is characterized in particular in that the bolstering means is produced "on demand" at the packaging site in a continuous manner, that the bolstering means is interposed between a container and at least one product brought in proximity with it, and finally that the insertion of the product into the container effects the interposition of the bolstering means between the internal walls of the container and the packaged product.

The invention also relates to a bolster or bolstering means particularly adapted to the method of the invention. Such a bolster includes at least one flexible base material of elongated shape, of indefinite length but cut to the dimension required on the packaging site; the base material has cushions at predetermined positions, and the bolster is notable because its base material includes at least two sheets or films weldable to one another in such a way as to constitute cushions or bulges filled with a swelling agent.

Finally, the invention relates to a packaging line adapted particularly to exploit the resources of the bolster according to the invention and to execute the method of the invention.

Further characteristics and advantages of the present invention will be better understood from the ensuing detailed description, referring to the drawings.

BRIEF DESCRIPTION OF THE DRAWINGS

FIGS. 9*a* and 9*b* shows another embodiment of a bolstering means according to the invention;

FIG. 1O shows another embodiment of a bolstering means according to the invention;

FIG. 11 is a diagram of an embodiment of a spacer element according to the invention;

FIG. 12 is a diagram of another embodiment of a spacer element according to the invention;

FIG. 13 shows another embodiment of a bolstering means according to the invention;

FIG. 14 is a view of a parcel constituted according to the invention;

FIGS. 18*a* and 18*b* shows another embodiment according to the invention.

DESCRIPTION OF THE PREFERRED EMBODIMENTS

Figure 1A:
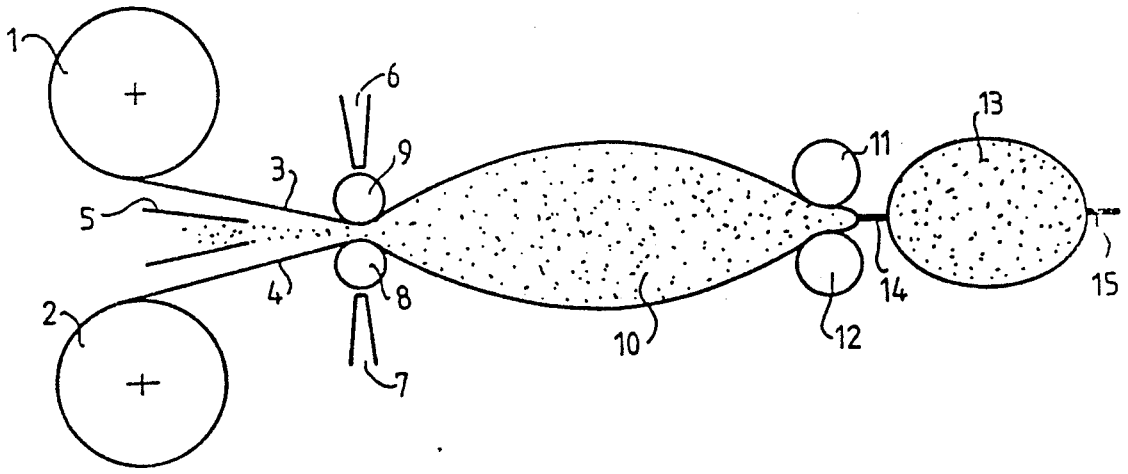
FIGS. 1*a* and 1*b* show two views of a packaging line according to the invention.

In FIG. 1, part of a packaging line according to the invention is shown. This part is a station for manufacturing the bolstering means or bolster according to the invention. Such a station includes a supply 1-2 of a flexible base material 3-4 or support means comprising a plastic film. In the exemplary embodiment of FIG. 1*a*, this film is composed of two films each rolled up on a spool 1 or 2 at the beginning of the production line.

In the packaging method according to the invention, the second step comprises making the bolstering means, preferentially at the packaging site itself. In this way, storage and transportation charges for the bolsters—dead costs that are of no use in the overall industrial process—can be avoided.

However, there is nothing to prevent, in certain applications, manufacturing the bolstering means elsewhere, for instance in the form of a strip of indefinite length that has a large number of bolstering means that are each cut from the strip at the packaging site.

Such a solution may be utilized in particular in the case where the rate of packaging per se is slower than the rate of manufacture of the bolstering means. In that case, a single station for manufacture of bolsters according to the invention may be installed at the head of the packaging lines, with several wrapping or packaging stations then receiving the bolstering means on demand.

In the embodiment of FIG. 1, a support comprising two films of flexible plastic are wound up on the spools 1 and 2 and are unwound in the course of the method of manufacture of the bolstering means or bolsters.

The drawn films pass between knurling rollers 8 and 9. In the space between the two films, there is at least one injection nozzle for injecting a swelling agent 5 with which a cushion 10, which is one embodiment of a damping element according to the invention.

Figure 1B:
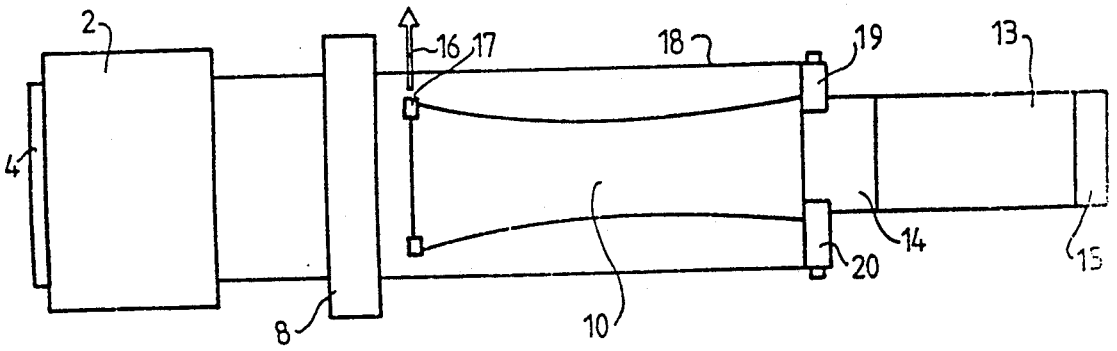

In FIG. 1*b*, which a view of the bolstering means manufacturing station from below, the definable of the cushion 10 can be seen. Two welding heads 17 can move apart in the course of the passage of the two films. During the longitudinal movement of the strip these soldering heads are in operation and can themselves be displaced in the perpendicular direction 16. Since the injection can be done with a pressure definable at the nozzle 5, it will be appreciated that any shape cushion is attainable.

Means 11 and 12 make it possible to trim off excess lateral portions of the base material, and they are wound on driving wheels 19 and 20. It is these wheels 19 and 20 that control the travel speed of the strip.

In FIG. 1 the strip along which the bolstering means according to the invention follow one another comprises a succession of spacer elements (cushions 10 and 13) separated by thin portions 14 that as will be seen below serve as a hinge for two portions of the bolster.

In FIG. 1, a cushion 10 is completed by welding performed by knurling wheels 6 and 7, shown in the inactive position in the drawing. The injection is then either shortened or considerably reduced to make portions 14, 15 of reduced thickness on the strip.

Figure 2:
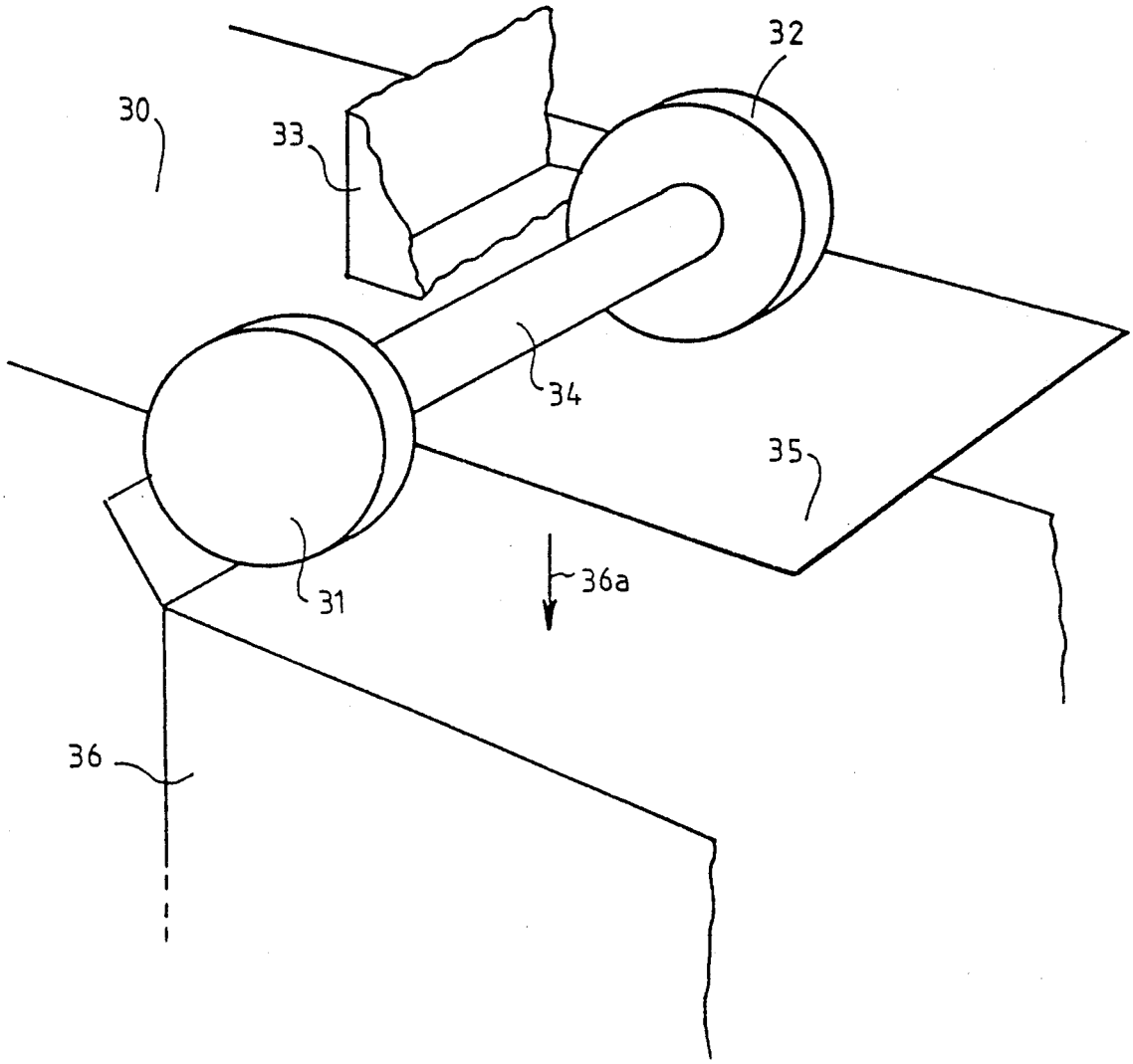
FIG. 2 is a view of part of a bolstering means according to the invention, prior to its insertion into a container.

In FIG. 2, another embodiment of a bolstering means according to the invention is shown, visible here only in part and in a different phase of the packaging method according to the invention, that is, the phase of insertion into a container.

According to the invention, the term "container" is used for any type of packing, or any means intended to constitute a packed package or parcel in which the bolster according to the invention performs its role surrounding a product.

Here, the container 36 is a cardboard box that includes an upper opening 36*a* by which the product 33 to be packaged is to be introduced. Only a lower corner of the product, which is parallelepiped in shape, is shown.

A bolstering means 30, only part of which is visible in the drawing, is disposed between the opening 36*a* of the container 36 and the product. This elongated strip includes a succession of cushions or spacer elements, such as the dumbbell-shaped element 31, 32, 34.

In this type of spacer element, a central portion 34 is intended to make the contact between part of the product and the corresponding inner face of the container 36. Here, the portion of the product 33 is its lower corner.

The two lateral portions 31 and 32 are the components of the spacer element whose function is to space the product apart from the lateral walls of the container. It can be seen that these two components of the spacer elements are obtained by displacing welding heads along an axis perpendicular to that of the travel of the base material in the course of manufacture of the bolster.

The element 31, 32, 34 is connected to its two neighbors, not shown, in the bolster by flat portions 30 and 35. They in fact comprise hinges so that the bolster can at least partly surround the product.

Figure 3:
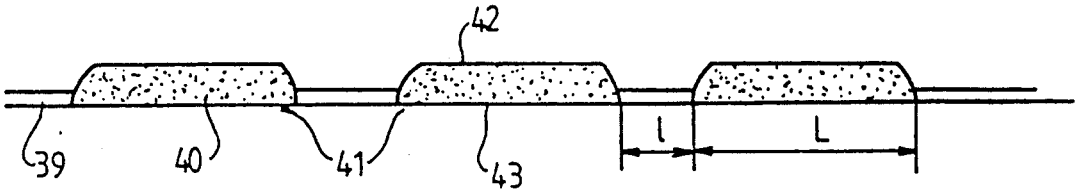
FIG. 3 shows an embodiment of a bolstering means according to the invention.

In FIG. 3, another embodiment of a bolstering means according to the invention is shown. Two films 42 and 43, one on top and one on the bottom, are stacked on one another, and cushions such as the cushion 40 are made locally by injection of a swelling agent. The swelling agent is held in the cushions by welded seams 41 that thus define portions that are empty or virtually empty of swelling agent 39 and thus act as hinges, and also serve as linking elements between the spacer elements 40 of the strip of bolsters.

In an off-site embodiment, the standardized strip shown in FIG. 3 is used. It serves to wrap a great variety of products in which the ratio between he dimensions is a constant. By regulating the respective lengths L and 1 of the spacer element and of the linking portion, adaptation to a greater number of situations becomes possible. Such a strip may be furnished to a packaging line that has no bolster manufacturing station and cut to length on demand.

Figure 4:
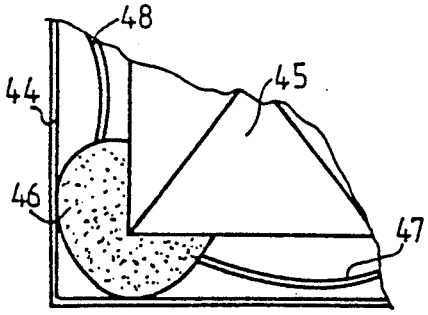
FIG. 4 is a sectional view of a package made with a different embodiment of a bolstering means according to the invention.

FIG. 4 shows a fragmentary section of a package or parcel constituted according to the invention is shown. A box 44 contains a product 45 and a bolster 46, 47, 48 is interposed between the two, in such a way that the spacer element 46 is disposed on one corner of the product. The element 46 is always made by the technique using a two-film base material, as can be seen at the two hinges 48 and 47.

Figure 5:
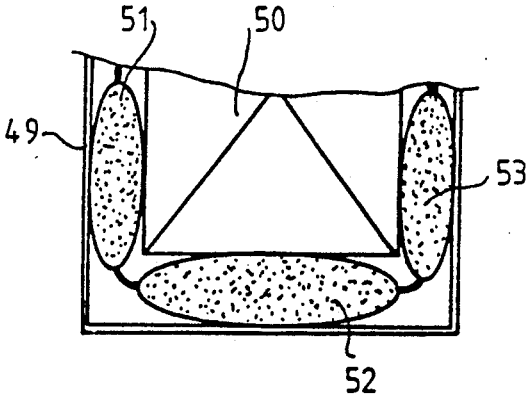
FIG. 5 is a sectional view of a package made with a different embodiment of a bolstering means according to the invention.

In FIG. 5, a different embodiment is shown, in which the spacer elements 51, 52, 53 are cushions that press on the sides of the product 50 and are interposed inside the box 49. It can be seen that two cushions are separated by short hinges between the welded seams of each cushion.

Figure 6:
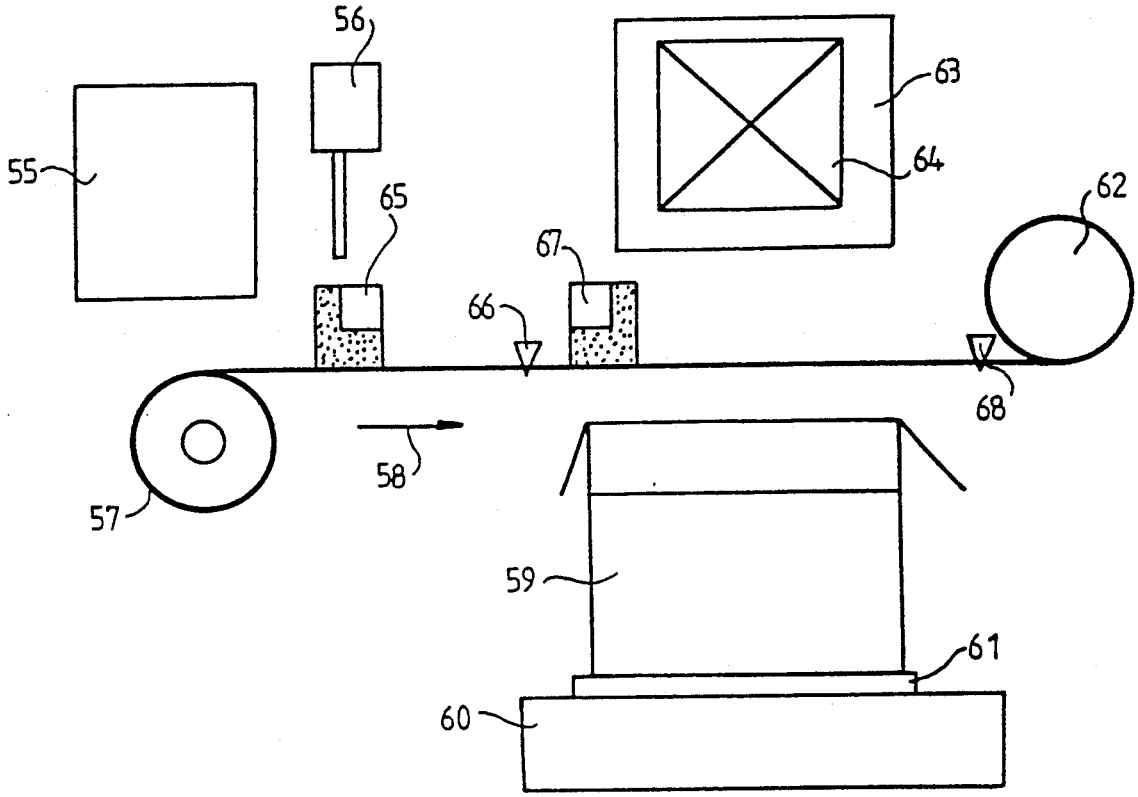
FIG. 6 shows another packaging line according to the invention, utilizing a different embodiment of a bolstering means according to the invention.

In FIG. 6, another embodiment of the invention is shown. A complete packaging station here is schematically shown, which primarily includes the bolster manufacturing station, and a station for loading the product into packages.

The bolster of the invention is always constituted on a thin base material in the form of an elongated strip of indefinite length, but the length is cut to the length desired in order to at least partly surround the product to be packaged.

The station for manufacture of the bolster includes a supply of flexible base material 57 which unwinds in the direction 58. On one side of the base material, a robot 55 deposits spacer elements 65, 67. Before the deposit of the spacer element, a robot 56 disposes a means for fixation of the spacer element 65 on the applicable face of the flexible base material.

Next, the robot 55 deposits the spacer element 65 in synchronism with the unwinding 58 of the base material. One element 67 has already been deposited, and the assembled set is moved to the station for loading the product 64 into packages.

The product 64 is brought by a robot 63, which deposits it above the opening of a box 59, which in turn is brought by a robot 60, 61.

The bolster is moved by the system already described in conjunction with FIG. 1, where the excess portions on the sides of the flexible base material are cut from the rest of the strip and wound onto rollers 62. The cutting is performed by knives 68. When a sufficient length of bolster is ready, the knife 66 cuts the strip perpendicular to the direction 58.

The product is then introduced through the opening of the container 59, in such a way that the spacer elements of the bolster are placed in the relative position desired. It will be noted that the directions of displacement of the product and container, on the one hand, and of the bolster, on the other, are perpendicular to one another.

Figure 7:
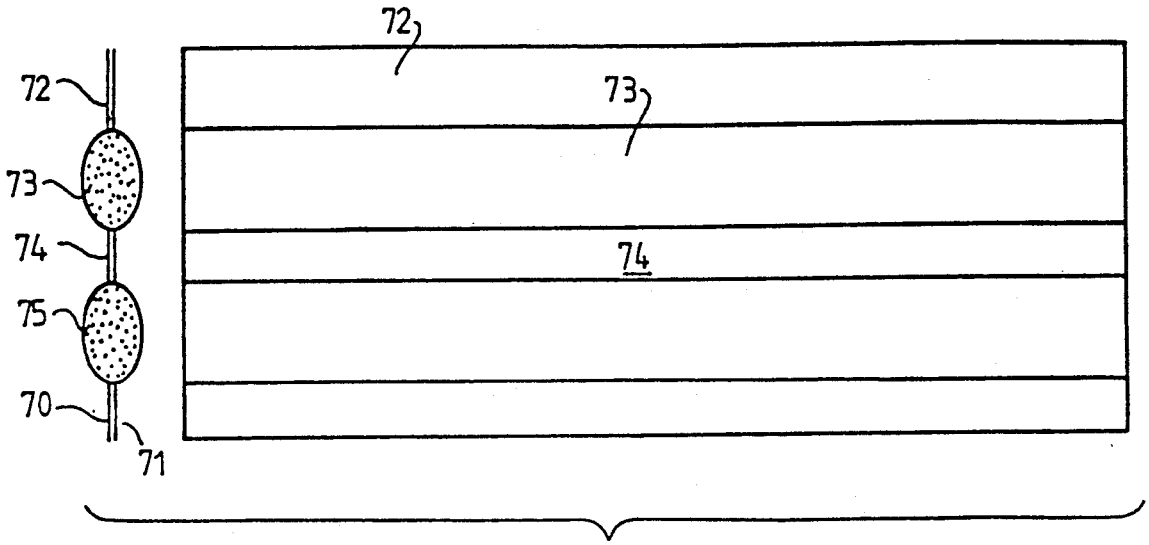
FIG. 7 shows a different embodiment of a bolstering means according to ,the invention.

In FIG. 7, another embodiment of a bolster according to the invention is shown. Made in the form of an elongated strip of a base material comprising two flexible films 70, 71, it includes two bulges 73, 75 separated from one another by a hinge 74, and these bulges are the spacer elements of the bolster.

The bulges 73, 75 may be greater in number (three or more). They may also be interrupted by welded seams made in the direction perpendicular to the direction of the strip, to product cushions separated by hinges in the longitudinal direction.

Other variants of the invention are possible. In particular, the container is not a specific necessity of the invention. The container may be embodied by the flexible base material itself.

Figure 8:
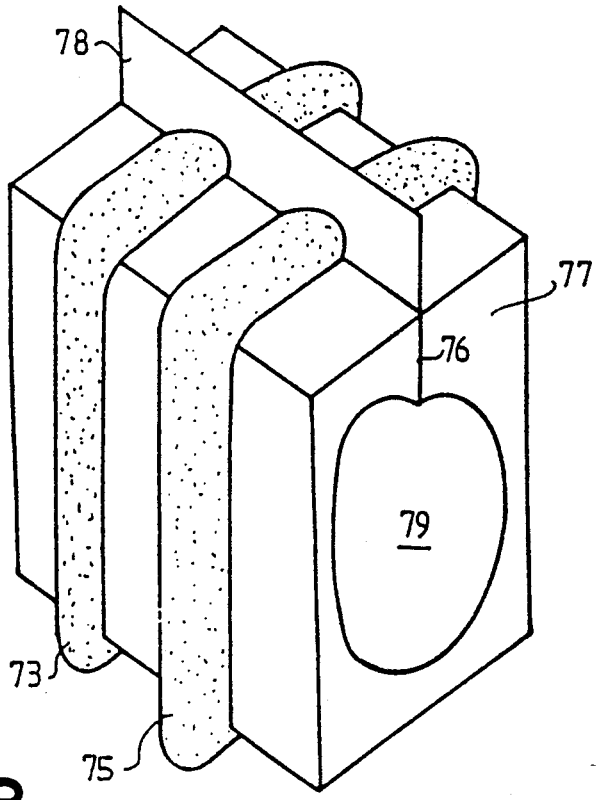
FIG. 8 is a view of a parcel constituted according to the invention.

In FIG. 8, a parcel made by the embodiment of the invention of FIG. 7 is shown, including the same reference numerals.

The two bulges 73 and 75 which serve as spacer elements completely surround the packaged product 79. Here they are disposed on the solid surface of the sides of the product, but it will be seen below that for certain applications it is preferable for the bolster to be disposed at the corners of the product.

Since these two spacer elements 73 and 74 are also made on a base of a plastic material that is mechanically strong and can be heat-shrunk, it is possible to make the container directly with this base material that is a constituent element of the bolster of the invention.

To this end, the parcel is manufactured on the packaging line by introducing the product/bolster set into a cooling jig, which temporarily plays the role of the container of FIG. 6. Once at least three sides of the product have been surrounded, a robot folds the excess bolster over the remaining free side and performs welding 76, by a means known to one skilled in the art, of the ends of the strip comprising the bolstering means. The result obtained is a sort of double fold 78 which can be engaged by grasping means, making the parcel portable.

In a following step in the packaging method of the invention, the lateral faces of the parcel in the cooling jig, that is, the faces not directly surrounded by the longitudinal bolster, are heated in such a way that the excess portions 77 of the base material shrink, lending mechanical strength to the parcel. Then the parcel is removed by grasping means made to engage the flap 78.

A considerable advantage of this packaging will be noted, which is that the cardboard boxes, in particular, can be replaced. Another considerable advantage is that enables the use of a translucent base material for presenting the product, whereas with the opaque packaging of the prior art the user could only tell what the packaged product was from an image placed on the opaque container by some graphic means. Hence there is no longer any need to open the parcels to have some idea of the product it contains or to find out its condition after storage or transport.

Another advantage is in terms of the labeling or marking by the placement of graphic or numerical characters, designs or colors that makes it possible for the packing to resume its role as an information carrier (bar codes of identification, numbers, registered trademarks) or for advertising.

In FIG. 9, another embodiment of a bolster according to the invention is shown. Here, in a view from above of the bolster alone, after its manufacture, the spacer elements are zones having a circular base, deposited on an elongated base material 80. They are distributed into two groups 81 and 82, meant to line the eight corners of the product after it has been introduced into a container or cooling jig. However, it will be noted that such a solution is not exclusive to parallelepiped products, but instead is applicable to any shape of product, whether the shape is regular or not.

In FIG. 9B, the bolster 80 is shown in the packaging process prior to its introduction into the cooling jig or container 83A. It will be noted that the product 83 is disposed on the bolster in such a way that it is balanced on the spacer elements. This signifies that there are as many spacer elements on the left of the cooling jig **83*a*** as on the right, prior to the introduction of the product into it.

In the same way, in the movement that introduces the product 83 into its cooling jig or container **83*a*, the edges 80*a* and 80*b*** of the bolster easily fold on top of the product, which ends the of the bolster easily fold on top of the product, which ends the packaging operation.

To make the parcel strong, it suffices to close the container **83*a*, if this version is selected, or to heat and weld the edges 80*a* and 80*b* of the bolster, if the element 83*a*** is a cooling jig rather than a container.

In the case of a cooling jig, the parcel is protected over the very great majority of its periphery by the flexible base material 80 which is heat-shrunk about the product 83, and it is protected at its corners, for the most frequent kind of dropping or impact, by the spacer elements at its eight corners. It will also be noted that the flexible base material is spaced apart from the walls of the product 83, which as in the conventional solution with a container such as a box contributes to preventing external forces from reaching the product 83.

In the case of a container of the cardboard box type, the flexible base material need not be either welded or heat-shrunk.

It is sufficient for a specialized robot to close the opening through which the product and its bolster have been introduced and attach a tie or some kind of fixation means.

Figure 10:
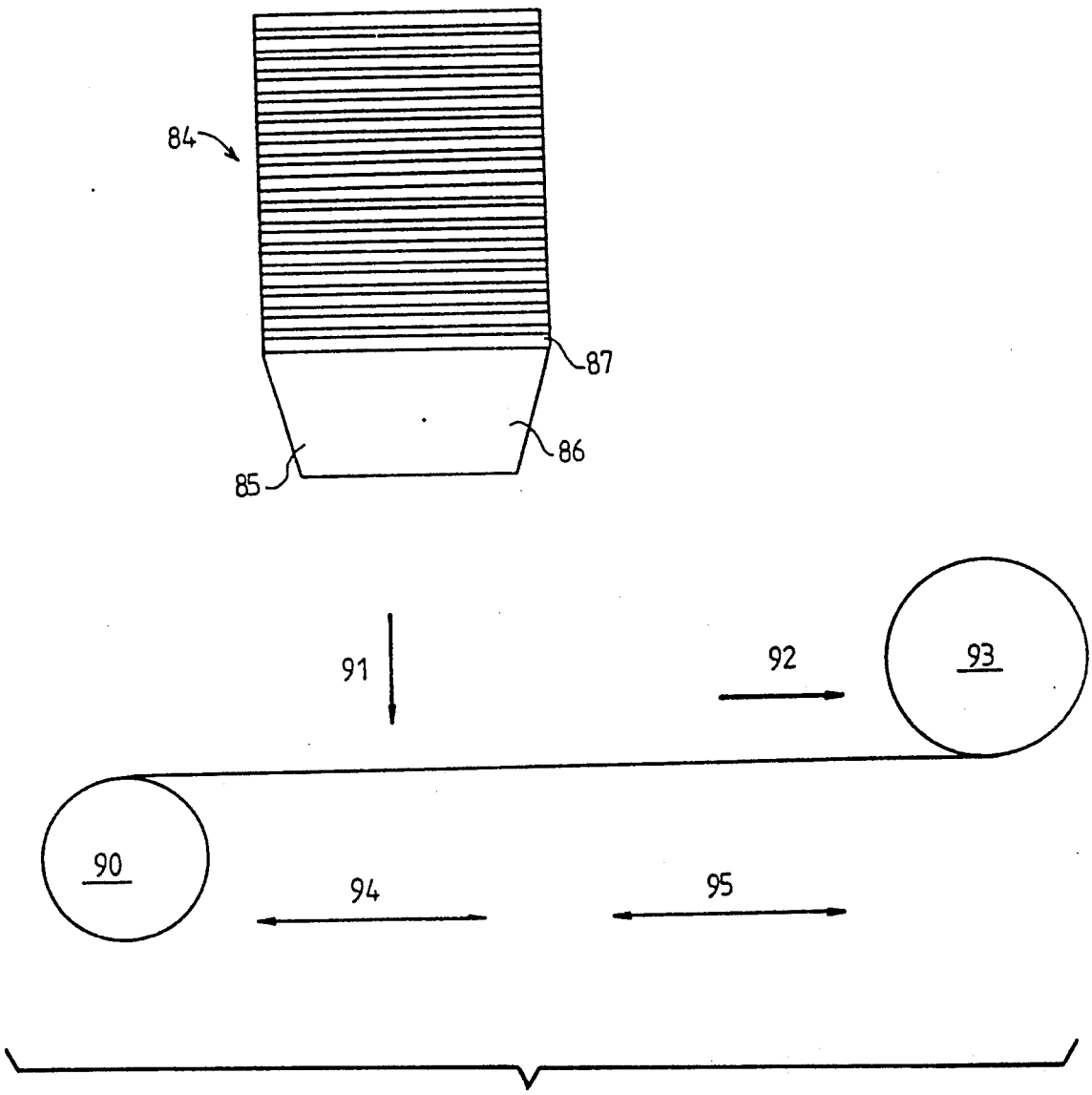

In FIG. 10, another type of bolster according to the invention is shown, which still includes an elongated base material in the form of a strip of indefinite length cut on demand and spacer elements made on this base material, but this type is also intended to act as a shock absorber if the package is dropped or the like.

Here, the spacer element, more particularly shown in perspective in FIG. 1, is unitized or separate; that is, its manufacture may be separate from that of the rest of the bolster, and there are a plurality of spacer elements for each packaging bolster.

In one manufacturing mode, not exclusive to the invention, the spacer element is made by forming of a thick film (typically several millimeters thick) of plastic material such as polyurethane. The film 87 is formed into a cup provided with two lateral fins which are intended either to press against one side of the product or to rest on an inside face of the container.

The cup includes two vertical faces 85 and 89, which join the fins 87 with a bottom which is substantially parallel to them.

In a preferred embodiment, this cup is of generally frustoconical or pyramidal shape, so that prior to the manufacture of the "on-demand" bolstering means, a large quantity of spacer elements will be stored near the bolster manufacturing station in a reduced volume. This solution also makes it possible to economize in terms of transport costs, if the spacer elements are not manufactured on the packaging line, because the volume transported is reduced.

In FIG. 10, a stack 84 of spacer elements according to the invention in the form of small cups is disposed in a robot for placement of spacer elements. This robot, not shown in FIG. 10 but within the competence of one skilled in the art, first provides a means for fixation of the spacer element on the base material initially stored on a supply wheel 90. The wheel 90 is moved by traction in the direction 92 by means 93, such as those described in conjunction with FIG. 1. Such means include means for pulling on excess lateral portions of the base material strip, with trimming done in the loading zone 95. It will be noted that these motive means must be disposed beyond the loading zone, to permit full efficiency of the invention. Particularly in the case where the product is introduced by gravity, the bolster prior to being trimmed also serves as a means of carrying the product at the time of the introduction. It is only in the course of this introduction that the trimming of the excess lateral portions is performed.

Before the loading zone, there is a zone 94 where spacer elements are deposited or made. In this zone, the robot for making spacer elements on the base material 90 deposits at least one spacer element by fixation, for example by gluing, on the face that faces the base material in the direction 91. It will be noted that the synchronism of this deposit in this direction 91 with the unwinding of the base material in the direction 92 assures a definable positioning of the spacer elements relative to the product to be packed in real time.

When a product is moved into the loading zone 94, its packaging characteristics (dimensions, fragility, shape) are discovered by a known means. The speed of travel in the direction 92 is then adapted to the instant of deposit and fixation of the spacer element in the direction 91.

In certain applications, the speed of travel of the base material in the direction 92 may be temporarily reduced to zero to permit the operation of depositing a spacer element.

In FIG. 12, a variant embodiment of a bolstering element according to the invention is shown. Here, beginning at an initial film, the bolstering element includes three frustoconical cavities or cups having different functions. The lateral fins 97 enable lending support to the spacer element, as will be seen below. The function of the central cavity 98 in FIG. 12 is to receive part of the periphery of the product to be packaged, which is a corner of the product, or a face or part of one. In fact, only the lateral edges 98*a* and 98*b* of the central cavity 98 are in contact with the product. The bottom of the cavity 98 remains spaced apart from the product, in order to perform the spacing function.

In an embodiment not shown in the drawing, the central cavity 98 is a damping cavity. To this end, its profile is in the form of a bellows, to constitute a spring the rigidity of which can be adapted to the fragility of the product and the conditions of its storage or transport over the time period in which it is packaged.

The two lateral cavities or cups 96*a* and 96*b* have the function of spacing the product apart from its container on the lateral faces relative to the bolstering. Their frustoconical shape also assures the that they are nestable, and they may be supplemented with a bellows shape to provide a spring for damping shock and other energy transmitted in a direction perpendicular to the bolstering direction.

Figure 17:
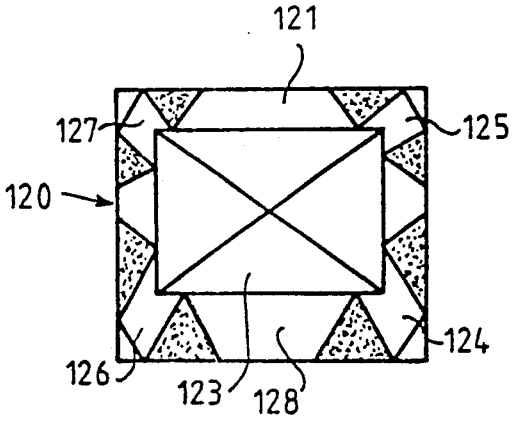
FIG. 17 is a diagram of a parcel constituted by the method of FIG. 11.

In FIG. 17, an embodiment of a parcel is shown using a bolster having cups as in FIGS. 10–13. The product 123 is enclosed in a container 120 such as a cardboard box.

It will be recalled that this solution is not exclusive to the invention; on the contrary, the base material of the bolster, when it is made of a heat-shrinkable plastic material having suitable mechanical characteristics, can serve as a container after passage through a cooling jig.

Four spacer elements 124–127, which have the shape described above, have been deposited on the bolster. It will be noted that their lateral fins such as 97 in FIG. 12 or 87 in FIG. 11 rest on the inside faces of the container 120.

Similarly, it will be noted that the cups of these spacer elements are disposed on the corners of the product 123. The base material completely surrounds the product. In the case where no box such as 123 is provided, it is always possible, if the base material is ready, to provide a container by welding the trimmed free ends of the bolster and effecting shrinkage by heating the base material.

In FIG. 13, another embodiment has been shown of a bolstering means according to the invention, of the type with cushion-shaped spacer elements filled with a swelling agent. Here, the purpose is to achieve packaging without an external box for a product 104-105 of irregular shape.

The bolster is made on a base 99 of indefinite length cut on demand to the dimension require for the product to be packaged. This base material includes lateral portions 100 and 101 intended partly to assure driving of the base material 99 along the packaging line, and furthermore, after trimming, to provide at least partial lateral protection for the product after forming of the parcel in the cooling jig.

The bolster is shown from above prior to introduction into the cooling jig. Two spacer elements 102 and 103 are provided on either side of the product such that these two elements are disposed about the vertical sides (that is, vertically in terms of the drawing) of the product and on their corners.

The base 104 of the product rests on first transverse portions of the spacer elements, which are obtained by a first welding perpendicular to the primary dimension of the two-film base material. The machine the principle of which is described in FIG. 1 is used to accomplish this. Welding devices are provided both in the direction of the strip, or longitudinally, and in the direction orthogonal to it, or transversely. The displacement and action of these devices are definable, so that the shapes of cushions or bulges shown in FIG. 13 can be achieved.

Thus the first spacer element 103 to move through the bolster manufacturing station is made by a first transverse welding 103*a* of the two films of the base material. The injection of the swelling agent then begins. By defining the injection output of swelling agent or by regulating the speed of longitudinal travel of the base material 99, a transverse bulge of predetermined size is made.

During this time, welding means weld the exteriors 103*b* of the spacer element 103. This welding will be continued for the entire duration of travel of the base material in the manufacture of the spacer element 103.

Once it arrives at the level of the edge 103*c* of the element 103, a transverse weld, the position and length of which are definable as a function of the desired shape of the bulge, is made.

Two injection nozzles are then necessary to make the two longitudinal bulges of the element 103. During the entire time of this double injection, four longitudinal welds, the transverse positions of which are definable as a function of the shape of the product to be packaged, are made by four independent heads.

Arriving at the level of the transverse edge 103*d*, a transverse weld is made to initiate the manufacture of the last transverse bulge of the spacer element 103. The injection of the swelling product is maintained, and finally a last transverse weld completes the spacer element.

After displacement of the base material by a desired length, which is a function of the corresponding dimension of the base on which the product to be packaged rests, the manufacture of the second spacer element 102 is begun in the same manner.

In FIG. 14, the parcel made by the method described in conjunction with FIG. 13 is shown.

The two elements 102 and 103 have been made in such a way that their external dimensions "mold" to the irregularity in shape of the product 105. They occupy the corners of the product, and the base material has been welded at its free edges 99, 106 of FIG. 13 to make a handle 107.

To bring the base material to the manufacturing station, the untrimmed excess portion 101 is folded onto the lateral face of the product after heat-shrinkage of the base material in a cooling jig, as already described.

The versatility of the invention will be noted, which makes it possible to manufacture bolsters of extremely varied shapes, so that it is adaptable to products of the most varied shapes and packaging characteristics.

Figure 15:
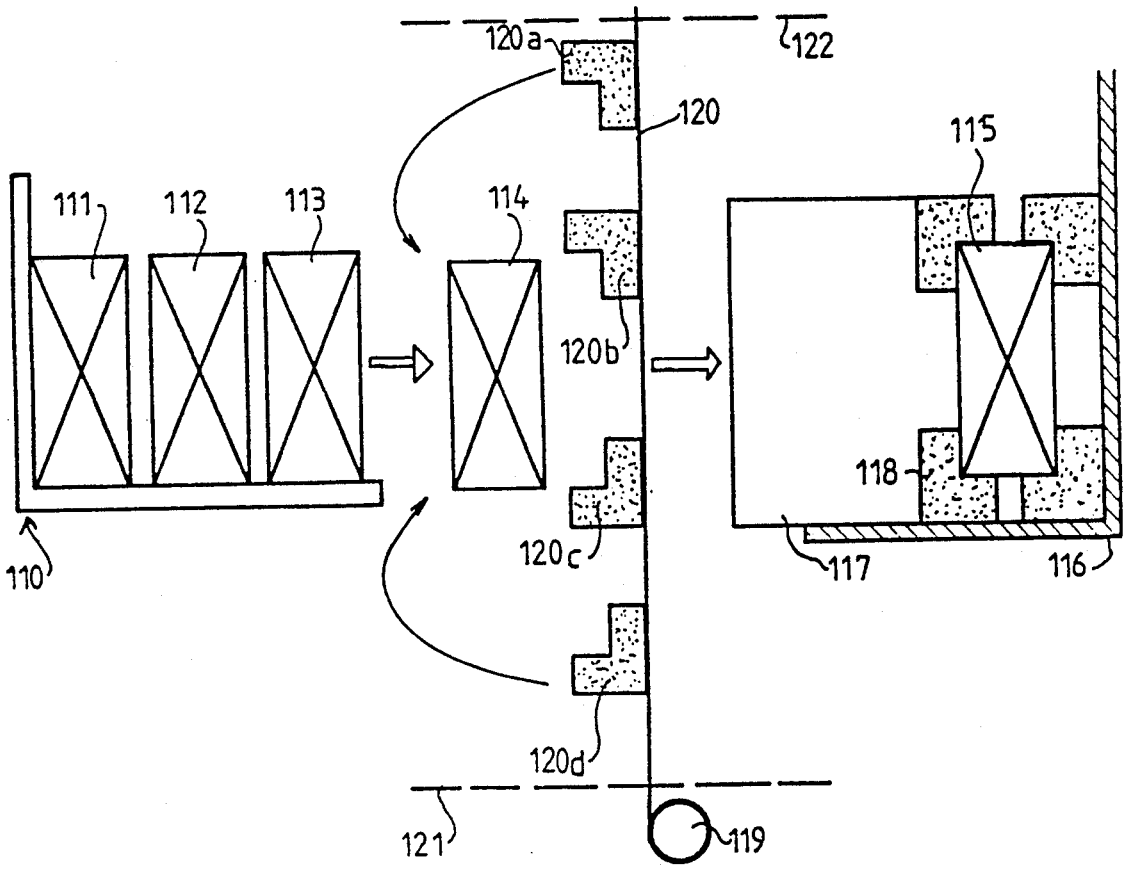
FIG. 15 illustrates a step in the packaging method in a variant of the invention.

In FIG. 15, one application of the invention is shown for making a single parcel for a plurality of products. A bolstering means is used that has the unit-type spacer elements such as those shown in FIG. 6. In this exemplary embodiment, it can be noted that the invention again works when the bolster/product set is introduced in some other way than by gravity or along a vertical axis.

A robot 110 successively loads products, which may have variable packaging characteristics, into a single container. Five products 111–115 are provided, with the product 115 having already been installed in the container 117 brought to the loading station 116 of the packaging line. The continuous strip of base material is furnished as described already, via a supply 119. The bolster is manufactured as already described between positions 121 and 122, where knives trim the bolster in the course of introduction of the bolster/product set 114 into the container via a loading arm (not shown) in the direction of the arrows.

The products are successively pushed in such a way as to completely fill the container 117.

As provided for the invention, the trimmed edges of the bolster 120 are folded progressively around the product in the course of its introduction into the container 117.

It will also be noted that four spacer elements 120*a*–120*d* are disposed to line the four corners of the product 114, as has already been done for the first product loaded, which is shown at 115. In a preferred embodiment, the four spacer elements such as 120*a*–120*d* are deposited onto the base material in such a way as to bolster only the face farthest to the right of the product 115, which abuts against the bottom of the container 117. Two spacer elements as shown in the drawing are disposed on the left-hand face of the product 115. These are the outermost spacer elements of the bolstering means. They have been given the shape of a T, so that the rightmost face of the following product (in this case 114) comes to be nested into these two elements.

Contrarily, for the N following products, only the lateral spacer elements such as 120*a* and 120*d* are deposited on the base material and assume a T shape to bolster the leftmost face of each product.

A parcel including a plurality of products in a single container can thus be made rapidly and at low cost.

It is also possible to use the base material of the bolstering means of the first product introduced into the cooling jig into the invention, by making it long enough to surround the parcel completely and by welding the edges and then shrinking it to make a parcel.

Figure 16:
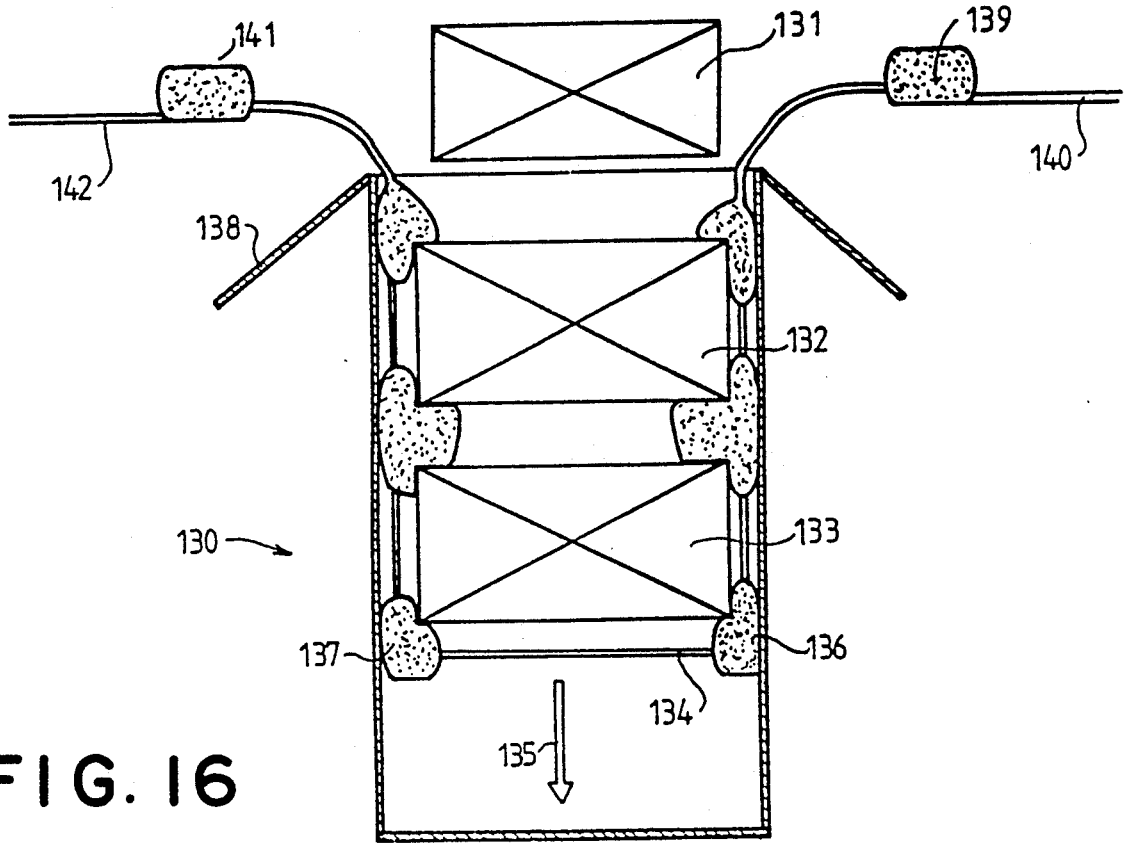
FIG. 16 illustrates a step in the packaging method in a variant of the invention.

In FIG. 16, an embodiment is shown of a parcel including a plurality of products, using bolstering with inflated cushions.

In this exemplary embodiment of a parcel according to the invention, three products 131–133 are introduced in succession into a container 130. A single bolster 140–142 is provided, which includes eight cushions. In a general manner, the invention here makes it possible to make bolsters with $2N+2$ cushions, if N products are to be packaged in a single parcel.

As before, the bolster is manufactured continuously. However, $N+1$ cushions are made initially, considering the dimensions of N products that are to be placed into the parcel. In the preferred embodiment, the cushions the farthest upstream of the method are manufactured prior to the introduction of the N products, but the invention is equally applicable to successive manufacture of these $N+1$ cushions that are the farthest upstream in the course of the introduction of the products.

Next, the first product 133 is approached by the bolstering means in the loading zone. The two cushions 136 and 137 at the bottom of the parcel are joined by the base material 134 and moved downward into the container 130.

The N products are successfully introduced into the parcel in the course of the unwinding of the bolstering means past a device for monitoring the loading operation. The N products then proceed along the direction 135 until they touch the bottom of the container 130, which terminates the loading operation.

Next, a robot performs the closure 138 of the opening of the container and assures its fixation, the parcel that has been made is evacuated, and the operation can begin over again.

It is also noted that the operation described in conjunction with FIG. 16 may, like the rest of the invention, also be performed either with a container of the cardboard box type or with a cooling jig that shapes the base material of the bolster according to the invention.

FIG. 18 is a view of the step of loading a product 155 on a bolstering means according to the invention, by which a high-strength parcel can be made.

In this parcel, the base material 150 has two spacer elements 153 and 154 of complementary hollow shapes, to enable completely bolstering the product on the one hand and making a compact parcel on the other, in which the spacer elements are contiguous; in certain embodiments, not shown, such spacer elements are even nested together.

Each spacer element includes two leading protrusions on a base, and the two leading protrusions of each of the spacer elements are in orthogonal directions, two by two.

In FIG. 18, it can be seen that the first bolstering element 154 includes two leading protrusions 158 and 159 transverse to the direction of the base material 150; their counterparts 156 and 157 in the second spacer element 153 are longitudinal. The respective lengths L and 1 are substantially equal to the dimensions of the product 155 to be packaged, just as the two depths of the spacer elements not visible in the view of FIG. 18*a* when added together have the value of the height of the product. In FIG. 18*b*, the parcel has been shown after passage to the cooling jig. The two spacer elements 153 and 154 are contiguous which guarantees strong solidity with the product.

Only four windows, such as the window 161, remain through which the product 155 can be seen.

Similarly, the excess lateral portions 152 and 151, after heat-shrinking, are trimmed as shown within circle, 162 the trimming being visible on the two lateral faces of the product, and the free edges of the base material are joined together at 160 to comprise a handle element.

Other shapes are possible, in particular those providing mortises and nesting between the contiguous spacer elements.

Such spacer elements are made from thermosettable resins, which are used as swelling agents in the method of the invention and which are in fact molded in the cooling jig.

The bolstering means may comprise a sleeve of material of controlled rigidity, such as, e.g., polyurethane.

In another embodiment, these spacer elements are made in unit fashion and placed as in the method of FIG. 6, for example.

What is claimed is:

1. A method for packaging at least one product in a container, with bolstering means being interposed between the container and the product, comprising producing the bolstering means at least in part "on demand" at a packaging site in a continuous manner in the form of a support strip of indefinite length, interposing the bolstering means between the container and at least one product brought in proximity with said bolstering means, and inserting the product into the container to effect the interposition of the bolstering means between the internal walls of the container and the packaged product.

2. The method of claim 1, wherein said support strip is a flexible case material and further comprising depositing on the flexible base spacer element (10, 13) having dimensions and mechanical characteristics determined as a function of the relative position of the element and the product once the product is installed in a container, and as a function of the packaging characteristics of the product.

3. The method of claim 1 wherein said flexible base material is a plastic film.

4. The method of claim 1, further comprising welding free edges of the flexible base material and thereafter heat-shrinking the flexible base of the bolstering means.

5. The method of claim 4, further comprising making a handle means with an excess portion of the free edges of the flexible base material after their being welded.

6. The method of claim 1, wherein the strip is formed of two films and further comprising injecting a swelling agent between the two films and welding the films progressively in the course of the travel of the film material past the station of manufacture of the bolster.

7. The method of claim 6, wherein the packaged product is passed through a cooling jig and the swelling agent is heat-set in the course of the passage of the cooling jig.

8. The method of claim 1, further comprising welding the strip in two directions, the first longitudinal and the second transverse and forming a shaped cushion between welds.

9. A method for packaging at least one product in a container, with bolstering means being interposed between the container and the product, comprising producing the bolstering means at least in part "on demand" at a packaging site in a continuous manner in the form of a support strip of indefinite length, interposing the bolstering means between the container and at least one product brought in proximity with said bolstering means, and inserting the product into the container to effect the interposition of the bolstering means between the internal walls of the container and the packaged product, the method further comprising depositing unit-type spacer elements on one face of the flexible base material in positions defined as a function of the characteristics of the product to be packaged.

10. The method of claim 9, further comprising depositing a fixation means between each spacer element and the flexible base material.

11. The method of claim 10 wherein the fixation means is a glue.

12. A packaging line for packaging products including at least one station for manufacture of a bolstering means for the packaged product, said one station including in a deposit zone a supply of flexible base material and means (5, 8, 9, 17) for forming spacer elements on the base material (3, 4), and at least one further loading station for loading at least one packaged product into a container.

13. The packaging line of claim 12, characterized in that said packaging line further includes motive means for the base material for moving the material in a longitudinal direction relative to the elongated shape of the base material.

14. The packaging line of claim 13, characterized in that the motive means for the base material comprise wheels (19, 20) which wind up the excess lateral portions of the base material and include means for trimming the excess material in a continuous packaging line while the packaged product is loaded into its container.

15. The packaging line of claim 12, including the means for synchronizing the step of forming the spacer elements with the longitudinal displacement of the base material of the bolstering means as a function of the geometric and packaging characteristics of the product present in the loading station.

16. A packaging line for packaging products including at least one station for manufacture of a bolstering means for the packaged product, said one station including in a deposit zone a supply of flexible base material and means (5, 8, 9, 17) for forming spacer elements on the base material (3, 4), and at least one further loading station for loading at least one packaged product into a container, said packaging line including means for synchronizing the step of forming the spacer elements with the longitudinal displacement of the base material of the bolstering means as a function of the geometric and packaging characteristics of the product present in the loading station, and wherein the base material comprises two films and the means for synchronizing the step of forming the spacer elements include two series of heads for welding the two films in at least one first direction perpendicular to the displacement of the base material and optionally in a second direction perpendicular to the first direction, called the transverse direction, the two series of heads being active in synchronism with the displacement of the base material and being definable as a function of the geometrical and packaging characteristics of the product present in the loading station.

17. A packaging line for packaging products including at least one station for manufacture of a bolstering means for the packaged product, said one station including in a deposit zone a supply of flexible base material and means (5, 8, 9, 17) for forming spacer elements on the base material (3, 4), and at least one further loading station for loading at least one packaged product into a container, further including a packaged product heating/cooling jig comprising a cavity forming a temporary container for the packaged product at the time of the loading operation, said jig being operable to shape the base material so as to provide a permanent shape to the packaged product by thermoforming of the outer film of the base material.

* * * * *

UNITED STATES PATENT AND TRADEMARK OFFICE

CERTIFICATE OF CORRECTION

PATENT NO. : 5,022,217

DATED : June 11, 1991

INVENTOR(S) : Jean-Claude Vilas Boas, et al

It is certified that error appears in the above-identified patent and that said Letters Patent is hereby corrected as shown below:

Column 11, claim 2, line 2, "case" should be --base--.

Signed and Sealed this

Ninth Day of March, 1993

*Attest:*

STEPHEN G. KUNIN

*Attesting Officer*

*Acting Commissioner of Patents and Trademarks*